US011583111B2

(12) United States Patent
Weinstein et al.

(10) Patent No.: US 11,583,111 B2
(45) Date of Patent: Feb. 21, 2023

(54) PORTABLE DISPLAY STAND HAVING MULTIPLE CONFIGURATIONS

(71) Applicant: Specialty Store Services, Inc., Des Plaines, IL (US)

(72) Inventors: Eric Weinstein, Des Plaines, IL (US); Evan Finke, Des Plaines, IL (US)

(73) Assignee: SPECIALTY STORE SERVICES, INC., Des Plaines, IL (US)

( * ) Notice: Subject to any disclaimer, the term of this patent is extended or adjusted under 35 U.S.C. 154(b) by 0 days.

(21) Appl. No.: 17/557,542

(22) Filed: Dec. 21, 2021

(65) Prior Publication Data

US 2022/0192396 A1 Jun. 23, 2022

Related U.S. Application Data

(60) Provisional application No. 63/129,441, filed on Dec. 22, 2020.

(51) Int. Cl.

| | |
|---|---|
| ***A47F 5/13*** | (2006.01) |
| ***A47F 5/14*** | (2006.01) |
| ***A47F 5/06*** | (2006.01) |
| ***A47F 5/00*** | (2006.01) |
| ***A47F 1/12*** | (2006.01) |

(52) U.S. Cl.

CPC ..... *A47F 5/132* (2013.01); *A47F 1/121* (2013.01); *A47F 5/0031* (2013.01); *A47F 5/06* (2013.01); *A47F 5/14* (2013.01)

(58) Field of Classification Search

CPC .. A47F 5/06; A47F 5/132; A47F 1/121; A47F 5/0031; A47F 5/14; A47F 5/105; A47F 5/04; A47F 5/01; A47F 5/106; A47F 5/10; A47F 5/16; A47F 11/02; A47G 5/00; E04B 2/74; E04B 2/7405; E04B 2/82; E04B 2/825; E04B 2/828; E04H 1/125; E04H 1/1255; E04H 1/1261; E04H 1/1266; G09F 7/18; G09F 15/0068; G09F 15/0037; G09F 15/0056

USPC ..... 211/169, 196, 205, 206, 194; 160/351, 160/352; 52/238.1, 239

See application file for complete search history.

(56) References Cited

U.S. PATENT DOCUMENTS

| | | | | |
|---|---|---|---|---|
| 406,196 A | | 7/1889 | Clayton | |
| 2,790,258 A | * | 4/1957 | Freshour | G09F 15/0068 248/167 |
| 2,954,126 A | * | 9/1960 | Middents | G09F 15/0068 211/190 |
| 3,092,256 A | * | 6/1963 | Vernik | G11B 33/0466 211/40 |
| 3,204,689 A | * | 9/1965 | Howell | E04B 2/7444 160/135 |
| 3,502,292 A | | 3/1970 | Yoder | |

(Continued)

*Primary Examiner* — Jennifer E. Novosad

(74) *Attorney, Agent, or Firm* — Shawn E. Duckworth; Dennemeyer & Associates, LLC

(57) ABSTRACT

A portable display stand for the display of merchandise having a hinged vertical support panel subassembly, including top and bottom panel segments, to reduce size and promote portability. Slideable pin locks slide out from a disengaged position and lock in the engaged position, to stabilize the top and bottom panel segments relative to each other, for assembly. A central post with attachment rings allows for attachment of 2, 3, or 4 support panel subassemblies arranged radially around the central post.

20 Claims, 12 Drawing Sheets

(56) References Cited

U.S. PATENT DOCUMENTS 3,583,466 A 6/1971 Dreyer
3,596,701 A * 8/1971 Cowan ..... G09F 15/0068 160/229.1
3,809,142 A * 5/1974 Bleeker ..... E04B 2/7444 160/135
3,817,396 A * 6/1974 Markson ..... A47F 5/105 211/198
3,924,749 A * 12/1975 Weston ..... A47F 7/0246 211/169
4,001,987 A * 1/1977 Coulthard ..... E04B 2/7442 40/605
4,030,219 A * 6/1977 Donovan ..... G09F 15/0068 211/195
4,127,196 A * 11/1978 Boucher ..... A47F 5/0815 52/645
4,288,937 A * 9/1981 Virsen ..... F16B 7/048 40/607.1
4,569,143 A * 2/1986 Bannister ..... E04B 2/7431 211/198
4,653,563 A * 3/1987 Bannister ..... G09F 15/0068 160/351
4,727,994 A 3/1988 Beaulieu
4,784,205 A 11/1988 Johnson
4,913,297 A * 4/1990 Wells ..... A47F 5/13 248/224.7
4,921,190 A * 5/1990 Russo ..... A47F 5/06 211/205
5,016,765 A 5/1991 Leonardo
5,090,725 A 2/1992 Feldner
5,255,803 A 10/1993 Pavone
5,280,840 A * 1/1994 Terpening ..... G09F 11/06 40/124
5,385,246 A 1/1995 Grossnickle
5,531,516 A * 7/1996 Peng ..... A47B 46/00 211/40
5,560,502 A 10/1996 Hsiung
5,579,703 A 12/1996 King
5,617,962 A 4/1997 Chen
5,918,750 A 7/1999 Jackson
6,131,560 A 10/2000 Healy
6,431,374 B1 * 8/2002 Winikoff ..... A47F 5/0876 211/105.1
7,373,746 B1 * 5/2008 Pettesch ..... G09F 7/18 40/605
7,448,634 B1 * 11/2008 Raub ..... A47F 5/083 211/186
7,874,090 B2 * 1/2011 Flagg ..... G09F 15/0068 211/175
7,980,519 B2 7/2011 Chen
8,082,971 B1 * 12/2011 Peterson ..... E04B 2/7427 40/606.16
8,181,797 B2 5/2012 Edwards
8,959,813 B2 2/2015 Denby
9,194,090 B2 * 11/2015 Raml ..... E01F 7/025
9,271,584 B1 3/2016 Weinstein
D825,941 S * 8/2018 Chopra ..... G06F 3/0484 D6/332
2005/0252422 A1 11/2005 Sharpe
2010/0018095 A1 * 1/2010 Molla ..... G09F 17/00 40/606.01
2022/0192396 A1 * 6/2022 Weinstein ..... A47F 5/132

* cited by examiner

PORTABLE DISPLAY STAND HAVING MULTIPLE CONFIGURATIONS

CROSS REFERENCE TO RELATED APPLICATIONS

This application claims the benefit of U.S. Provisional Application Ser. No. 63/129,441 filed on Dec. 22, 2020, which is incorporated herein by reference in its entirety.

FIELD OF INVENTION

This invention is related to display stands, and, more particularly, to lightweight, portable display stands that are capable of multiple configurations and may be readily assembled and disassembled without tools.

BACKGROUND OF THE INVENTION

Display stands for exhibiting, among other things, goods or other items (together "merchandise") have been in wide use for many years. Various types of display stands are commonly seen in retail stores such as supermarkets, hardware stores, discount stores, and a multitude of other locations such as trade shows or events. Display stands may be permanent, semi-permanent, or temporary in nature.

Display stands typically include a perforated, slotted, or gridded support panel configuration with the front of the panel facing the intended viewers. Perforated, slotted, or gridded panels commonly include slatwall, gridwall, slatgrid, pegboard, or other designs.

Removable fixtures for exhibiting or displaying merchandise include hooks, braces, shelves, or brackets that are adapted to fit into the perforations, slots, or grids of, or wrap around the support features of, the support panel in a manner wherein the hooks, braces, shelves, or brackets are supported by the support panel. The removable fixtures generally extend more or less outwardly from the front of the support panel. The removable fixtures may be used to exhibit or display the merchandise itself (such as when a hook fits through a hole in the products' packaging to support the package on the hook). Removable fixtures may also, in turn, support shelving, baskets, or other associated support fixtures or accessories (together "accessories") that may be utilized to display merchandise.

The removable fixtures are commonly designed to be removable and repositionable on the front of the support panel of the display stand so as to promote flexibility in changing or refashioning the arrangement and appearance of merchandise displays.

While some display stands are permanent or semi-permanent, there is often a desire for at least some display stands at a given location to be temporary or portable, or both, in order to promote flexibility in the arrangement of the layout and configuration of display stands within the floor space in that given location, or in multiple locations. Temporary and portable display stands are especially useful in promoting that flexibility. There is also a desire for the support panels to be capable of being arranged in multiple configurations thereby increasing the versatility and flexibility of the display stand. Optionally, the support panels on free standing display stands can allow for display of items on both the front and back of the support panels.

Temporary and portable display stands are also especially desirable in environments where merchandise display stands are to be set up quickly, sometimes in locations far from the display stands' owner's usual location, displayed for a relatively short time, and then disassembled and removed quickly from that location, sometimes for transport and reassembly elsewhere, and sometimes for transport and storage (short-term or long-term). The desirability of such temporary and portable display stands, for example, would exist for some display stands used at trade shows, craft shows, art shows, or conventions (together "trade shows"). In those instances, it is often very desirable that display stands be highly portable, be capable of being quickly and easily assembled (very preferably without tools, and with the display stand having minimal parts, to avoid separation and loss of or damage to or by those parts), be lightweight, be sturdy (to withstand the impact of the high volume of people accessing the displayed items at a trade show), be capable of being quickly and easily disassembled, and be easily and neatly packable, storable, and transportable in stored form.

It is a limitation of prior art display stands that have been designed to promote portability that they have lightweight structures and are generally less sturdy, are prone to having many separable parts, are often difficult to assemble or disassemble quickly, and require tools for such assembly and disassembly.

SUMMARY OF THE INVENTION

Accordingly, prior to the invention of the display stand that is described further herein, a need remained for a display stand that included all of the following features, and properties discussed above, in a single display stand unit.

It is an object of this invention to provide a display stand that may be quickly and easily assembled and disassembled, without tools and to provide a display stand design that promotes superior stability as compared to prior art portable display stand designs.

It is a further object of this invention to provide a display stand that, when disassembled, includes very few individual, non-attached parts or sub-assemblies so as to avoid separation, loss, or damage of parts or sub-assemblies during assembly, disassembly, transport, or storage. In particular, in one of the preferred embodiments of the invention, the slotted, perforated, or gridded support panel sub-assembly is formed of multiple connected segments to promote portability and easy storage, with the multiple segments of the support panel subassembly being hinged to each other to form a one-piece construction, in order to prevent individual segments from being separated from each other, thereby avoiding loss of or damage to the multiple individual segments, and in order to facilitate fast and easy assembly and disassembly as a result of alignment facilitation resulting from the hinged construction. Relatedly, it is an object of the invention to promote easy disassembled stowage and transport of the display stand.

It is a still further object of the invention to provide a display stand that is capable of multiple assembly configurations to customize the display area for particular goods, available space, or desired aesthetic impact.

The present invention is an improvement of the invention described in U.S. Pat. No. 9,271,584, issued to Specialty Store Services, Inc. on Mar. 1, 2016. The disclosure in U.S. Pat. No. 9,271,584 is incorporated by reference herein in its entirety.

The portable display stand of the present invention includes a support panel subassembly, preferably split into multiple segments, and more preferably split into two segments (a top panel segment and a bottom panel segment), with the split in the support panel subassembly running in the horizontal direction across the face of the support panel subassembly, preferably near the vertical mid-point of the support panel subassembly. The width of the support panel subassembly in the range of about 20 inches to about 30 inches, preferably in the range of about 24 inches to about 25 inches. The height of the support panel subassembly is in the range of about 60 inches to about 70 inches, preferably in the range of about 60 inches to about 65 inches. In a preferred embodiment having a support panel subassembly split into two segments, the height of the top segment is in the range of about 28 inches to about 32 inches and the height of the bottom segment is in the range of about 30 inches to about 35 inches. The support panel subassembly is perforated, slotted, gridded, or otherwise adapted to accept removable fixtures, such as hooks, braces, shelves, brackets, or other accessories for displaying or exhibiting merchandise. In an embodiment, two or more support panel subassemblies may be attached together.

The support panel subassembly has a first side edge and a second side edge and is supported at its side edges by first and second braces. The first and second braces are preferably a hollow, tubular construction, and more preferably, constructed of a tubular metal. In an embodiment, the first and second braces extend the length of the side edges of the support panel subassembly. In another embodiment, the first brace extends only a portion of the length of the first side edge of the support panel subassembly, preferably along the vertical mid-portion of the support panel subassembly. Preferably, the braces are each split in the horizontal direction at a location that corresponds with the split between the top and bottom segments of the support panel subassembly, so as to form a first top brace, a first bottom brace, a second top brace, and a second bottom brace.

The split between the first top brace and the first bottom brace frames a first gap in the first brace. Likewise, the split between the second top brace and the second bottom brace frames a second gap in the second brace. The first top brace includes a hollow tubular portion proximate to the first gap, and the second top brace includes a hollow tubular portion proximate to the second gap. The first bottom brace includes a hollow tubular portion proximate to the first gap, and the second bottom brace includes a hollow tubular portion proximate to the second gap. Furthermore, the first bottom brace includes a hollow tubular portion distal from the first gap, and the second bottom brace includes a hollow tubular portion distal from the second gap.

The first and second braces are each attached to, and preferably permanently attached to, opposite sides of the support panel subassembly, such as by welding or soldering, or are each formed integrally with opposite sides of the support panel subassembly. The first top brace is attached by a first hinge to the first bottom brace, and the second top brace is attached by a second hinge to the second bottom brace.

The first and second hinges permit folding of the top panel segment and bottom panel segment of the support panel subassembly, that is, the hinges permit folding (at the first gap and second gap) of the first top brace and first bottom brace, on the one hand, and the second top brace and second bottom brace, on the other hand, as well as the attached top panel segment and bottom panel segment of the support panel subassembly, along the split in the horizontal direction of the panel located at or near the vertical midpoint, allowing compact stowing and easy transport of support panel subassembly when folded. The first and second hinges maintain critical alignment of the first top brace and first bottom brace, as well as the second top brace and second bottom brace of the first and second braces, respectively, when the support panel subassembly is unfolded (for assembly) so that the first top brace and first bottom brace, on the one hand, and the second top brace and second bottom brace, on the other hand, align without the need for simultaneously visually and manually lining up the first and second top and bottom braces to permit the assembly and stabilization of the first and second braces as discussed further herein. Simultaneously lining up tubular parts during assembly has been a particularly difficult and time-consuming task in prior art portable display stands having multiple unconnected tubular parts, and particularly multiple unconnected tubular insertable parts, given the somewhat flexible and unwieldy nature of past designs for portable display stands.

In order to secure the support panel subassembly and the first and second braces in the unfolded (assembled) position, the portable display stand includes (preferably two) slideable pin locks (one for the first top brace and first bottom brace, and one for the second top brace and second bottom brace) which, when slid into engagement, fit snugly within the hollow tubular portions (proximate to the first and second gaps) of both the top and bottom braces of the first brace, and both the top and bottom braces of the second brace, respectively, so as to stabilize the top panel segment of the support panel subassembly relative to the bottom panel segment of the support panel subassembly. The slideable pin locks may also be attached to the exterior of the first brace, the second brace, or both, and slide into engagement with an arcuate open space or hollow tube attached to the exterior of the brace to stabilize the panel segments without departing from the invention.

The first and second slideable pin locks each include one or more locking mechanisms (such as bolts) which are preferably able to be hand locked (hand-tightened in the case of bolt locking mechanisms). When the slideable pin locks are in the non-engaged position, the first and second slideable pin locks fit inside of either the hollow tubular portions of the first and second top braces proximate to the first and second gaps, or within the hollow tubular portions of the first and second bottom braces proximate to the first and second gaps, and are secured in the non-engaged position using the locking mechanisms (such as the hand-tightened bolts previously mentioned).

When the support panel sub-assembly is unfolded to the fully opened position and the hollow tubular portions of the first top brace and first bottom brace, and the second top brace and second bottom brace, respectively, are aligned, the slideable pin locks of the first and second vertical braces may be: (1) unlocked from the disengaged position (such as by loosening the hand-tightened bolts); (2) slid and extended partially from within the hollow tubular portions of either the first top brace or first bottom brace portions of the first brace proximate to the first gap (wherever they are optionally situated in the disengaged position), and extended to fit snugly inside of the corresponding opposing hollow tubular portion of the first brace, thereby strengthening and stabilizing the hinged connection of the first top brace and first bottom brace, and, as a result, strengthening and stabilizing the top panel segment and the bottom panel segment of the support panel subassembly; (3) slid and extended partially from within the hollow tubular portion of either the second top brace or second bottom brace segments of the second brace proximate to the second gap (where they are situated in the disengaged position), and extended to fit snugly inside of the corresponding opposing hollow tubular portion of the second brace in order to further and similarly strengthen and stabilize the hinged connection of the second top brace and second bottom brace, thereby strengthening and stabilizing the top panel segment and the bottom panel segment of the support panel subassembly; and (4) locked in the engaged position (such as by hand-tightening the bolts for the slideable pin locks).

Preferably, a slot is formed in the first and second bottom braces, and in the first and second top braces, to permit movement of the locking mechanisms of the first and second slideable pin locks between the disengaged and engaged positions. Because the first and second slideable pin locks are locked in the disengaged positions when the support panel subassembly is in the disassembled folded position, separation and potential loss of these small but critical parts, namely, the first and second slideable pin locks and associated locking mechanisms, especially during disassembly, storage, or transport, is avoided.

A leg subassembly preferably includes a horizontal leg support and a tubular vertical leg support that are permanently attached to each other, such as by welding or soldering. Preferably, the horizontal leg support is substantially circular and has a diameter in the range of about 4 inches to about 10 inches, preferably about 6 inches. The leg subassembly preferably is made of a tubular metal.

The vertical leg support extends preferably substantially transversely from at or near the midpoint of the horizontal leg support. Preferably, leg levelers may be attached to the bottom of the horizontal leg support. The leg levelers include headless bolts, or other known means, to permit leveling of the leg subassembly on uneven surfaces. The headless bolts terminate in horizontal feet. The headless bolts screw inwardly and unscrew outwardly in their location in the bottoms of the horizontal leg support and thereby may be shortened or lengthened as needed, by hand, in order to lower or raise the horizontal feet to level the portable display stand for stability. Other attachments (for example, casters) may be connected to the bottom of the horizontal leg support as substitutes for the leg levelers, or the leg levelers or other attachments may be omitted in their entirety, without departing from the invention.

The leg subassembly is attached to the second bottom brace. The tubular vertical leg support fits snugly within the hollow tubular portion of the end of the second bottom brace that is distal from the second gap.

The leg subassembly may then be secured to the hollow tubular portion of the second bottom brace using tool-free attachments. A preferable example of a tool-free attachment for attaching the leg subassembly may be one or more (preferably two) spring-plungers per leg subassembly which are preferably permanently attached to the hollow tubular portion of the second bottom brace that is distal from the second gap, adjacent to brace apertures, and which, when engaged, cause the tips of plungers to fit through the brace apertures and then into corresponding leg apertures in the vertical leg support of the leg subassembly. For assembly, the plungers are retracted (such as by pulling by hand) allowing the vertical leg support to be fully inserted into the hollow tubular portion of the second bottom brace that is distal from the second gap, and thereby permitting the leg apertures of the vertical leg support to become aligned with the brace apertures and plungers. The plungers are then released and a spring bias causes the tips of the plungers to insert through the brace apertures into the corresponding aligned leg apertures, securing the leg subassembly in place. For disassembly, the plungers are retracted (by pulling) releasing the leg apertures so that the leg subassembly may be removed (by lifting and sliding) in a tool-free manner. The spring plungers preferably remain permanently attached to the hollow tubular portion of the second bottom brace adjacent to the brace apertures during disassembly.

An alternative tool-free attachment that may be used to secure the vertical leg support of the leg subassembly to the second bottom brace is spring buttons. Spring buttons may be attached to the vertical leg support (or to the second bottom brace) in a manner such that the spring buttons engage corresponding apertures in the second bottom brace (or in the vertical leg support). For disassembly, the spring buttons may be depressed, releasing the corresponding apertures of the second bottom brace (or vertical leg supports), permitting removal of the leg subassembly in a tool-free manner. The spring buttons are not removed from the leg subassembly (or second bottom brace) during disassembly of the portable display stand.

Once the support panel subassemblies are secured in the unfolded (assembled) position, the display stand can be arranged in a variety of configurations. The desired number of support panel subassemblies are secured to a vertical central post; preferably two, three, or four support panel subassemblies are used. In an embodiment, additional support panel subassemblies are secured to the support panel subassemblies secured to the vertical central post. The overall height of the portable display stand in its assembled configuration is in the range of about 70 inches to about 85 inches, preferably about 80 inches.

The vertical central post can be unitary in construction or have multiple segments. Preferably, the post or post segments are of hollow construction to decrease the mass of the display stand and to allow the post segments to fit together for tool-free assembly. If having multiple segments, preferably the segments fit together whereby the inner diameter of an upper end portion of a bottom post segment is of a slightly larger diameter than the outer diameter of a lower end portion of a top post segment such that the lower end portion of the top post segment fits within the upper end portion of the bottom post segment. In embodiments having more than top and bottom post segments, the middle post segments will have an upper end portion with an inner diameter of a slightly larger diameter than an outer diameter at a lower end portion. A ridge or stop adjacent the lower end portion of the top or middle post segments may be added to limit the distance the lower end portion is inserted into an upper end portion. In a preferred embodiment, the diameter of the central post is in the range of about 1 inch to about 2 inches, preferably about 1¼ inches at the widest point and 1 1/10 inches at the narrowest point.

The vertical central post has a plurality of support disks. If the vertical central post is comprised of multiple segments then each post segment preferably has a support disk, preferably unitary with the post segment. The support disk is a substantially flat, circular disk that extends horizontally from the vertical central post and has a diameter larger than the diameter of the vertical central post. In a preferred embodiment, the diameter of the support disk is in the range of about 3 inches to about 5 inches, more preferably about 3½ inches.

The vertical central post is supported by a central base, and optionally, the central base has leg levelers as previously described on the horizontal leg support of the leg subassembly. Preferably the central base is substantially circular and has a diameter in the range of about ten inches to about 14 inches, preferably about 12 inches. The central base has a base aperture, preferably at or near the mid-portion of the central base, such that the lower end portion of the vertical central post or the lower end portion of the bottom post segment fits within the base aperture. In an embodiment, the engagement of the lower end portion of the vertical central post or the lower end portion of the bottom post segment and the central aperture is a threaded engagement. In an embodiment, the central base is about ½ inch high. For stability in use, yet ease of transport, in an embodiment, the weight of the central base is in the range of about 3 pounds to about 10 pounds, preferably about 5 pounds.

Attachment rings are used to secure the support panel subassemblies to the vertical central post. Each attachment ring is preferably a substantially flat ring having a post aperture and a diameter larger than the diameter of the vertical central post. In a preferred embodiment, the diameter of the attachment ring is in the range of about 4 inches to about 6 inches, more preferably about 4⅓ inches. The attachment ring rests on top of each support disk on the vertical central post. For example, in an embodiment where the vertical central post is comprised of three post segments, a bottom post segment is positioned vertically on the central base such that the lower end portion of the bottom post segment fits within the base aperture in the central base. The attachment ring with a post aperture is positioned such that the upper end portion of the bottom post segment passes through the post aperture of the attachment ring and the attachment ring rests on the support disk in the bottom post segment. A middle post segment is then positioned vertically above the bottom post segment such that the lower end portion of the middle post segment fits within the upper end portion of the bottom post segment. A second attachment ring is positioned such that the upper end portion of the middle post segment passes through the post aperture of the second attachment ring and the attachment ring rests on the support disk in the middle post segment. A top post segment is positioned above the middle post segment such that the lower end portion of the top post segment fits within the upper end portion of the middle post segment. A third attachment ring is positioned such that the upper end portion of the top post segment passes through the post aperture in the attachment ring and the attachment ring rests on the support disk in the upper post segment. Optionally, an end cap can be placed on the upper end portion of the top post segment (or central post) to cover the interior of the vertical central post.

Spaced around the circumference of the attachment rings are a plurality of attachment apertures used for holding the support panel subassemblies in position relative to the vertical central post. As viewed from the top, preferably, the attachment apertures are arranged at the 12 o'clock, 3, 4, 6, 8, and 9 o'clock positions. Once the vertical central post is assembled, the desired number of support panel subassemblies is positioned relative to the vertical central post via engagement with the proper attachment aperture. The first side edge of each support panel subassembly includes at least one attachment knuckle having an axial continuous passage for receiving an attachment pin for attaching the support panel subassembly to the vertical central post. In an embodiment, the second side edge of each support panel includes at least one outer attachment knuckle having an axial continuous passage for receiving an attachment pin for attaching the support panel subassembly to a second support panel subassembly. The attachment pin includes a shank, and a head disposed at an upper end of the shank. To securely attach the attachment knuckles to the attachment rings or the outer attachment knuckles, the attachment pins may include spring buttons. The spring buttons may be attached to the lower end of the shank in a manner such that when the attachment pin is inserted through the axial continuous passage and attachment aperture or the outer attachment knuckle's axial continuous passage, the button of the spring engages an underside of the attachment ring or outer attachment knuckle. For disassembly, the spring buttons may be depressed, releasing the attachment pin from the corresponding apertures of the attachment ring or outer knuckle, permitting removal of the support panel subassemblies in a tool-free manner. Preferably, the attachment knuckles are welded directly to the support panel subassembly. However, the attachment knuckles may be soldered, glued, or fixedly attached to the support panel subassembly. The attachment pins are preferably removably attached directly to the support panel subassembly. In an embodiment where the first brace extends the length of the first side edge of the support panel subassembly, the attachment knuckles may be attached to the first brace. In an embodiment where the second brace extends the length of the second side edge of the support panel subassembly, the outer attachment knuckles may be attached to the outer brace. Preferably each support panel subassembly includes a number of attachment knuckles and outer attachment knuckles equal to the number of attachment rings found on the vertical central post. In the embodiment described above, where the vertical central post is comprised of three segments, each support panel subassembly has three pairs of attachment knuckles and outer attachment knuckles, two pairs on the top support panel segment and one pair on the bottom support panel segment. In a preferred embodiment, the distance between the uppermost attachment knuckle and the middle attachment knuckle is about 21 inches whereas the distance between the middle attachment knuckle and the bottom attachment knuckle is about 33 inches. The attachment knuckles and the attachment apertures encircling the attachment rings are arranged such that the axial continuous passages and the attachment apertures are coaxially aligned. Similarly, the attachment knuckles and outer attachment knuckles are arranged such that the axial continuous passages of the knuckles and outer knuckles are coaxially aligned. In the embodiment described above, attachment pins are adjustably attached to the first side edge of support panel subassembly above the attachment knuckles. The attachment pins are inserted into the axial continuous passage of the attachment knuckle and the attachment apertures so that the head of the pin abuts the attachment knuckle. The attachment pins engage with the attachment apertures encircling the attachment rings such that each support panel subassembly extends radially from the vertical central post. The second side edge of each support panel subassembly extends to the vertical leg support. In an embodiment, attachment pins are inserted into the axial continuous passages of the attachment knuckle and outer attachment knuckle so that the head of the pin abuts the attachment knuckle. The attachment pins engage with the outer attachment knuckle on the second side edge of the support panel subassembly such that these support panel subassemblies extend radially from the vertical central post.

Optimally, a carrying case (preferably made of ballistic nylon or other suitable material) or other container of suitable size is used for stowing the subassemblies of the portable display stand when they are disassembled from each other. The small number of separate subassemblies when disassembled is highly advantageous. No small separable parts are required to be located for assembly or stored following disassembly, avoiding the risk of separation and loss of parts, or damage to or from loose parts, when they are disassembled or stowed. Assembly or disassembly of the portable display stand may occur entirely without tools and may take place in less than a minute. The display stand, especially when stowed in the carrying case, is highly portable. It may be hand carried in the carrying case, which preferably includes a handle, or the carrying case may include a shoulder strap permitting the person carrying the stowed portable display stand to have his or her hands free for other purposes.

DETAILED DESCRIPTION OF THE INVENTION

Figure 1:
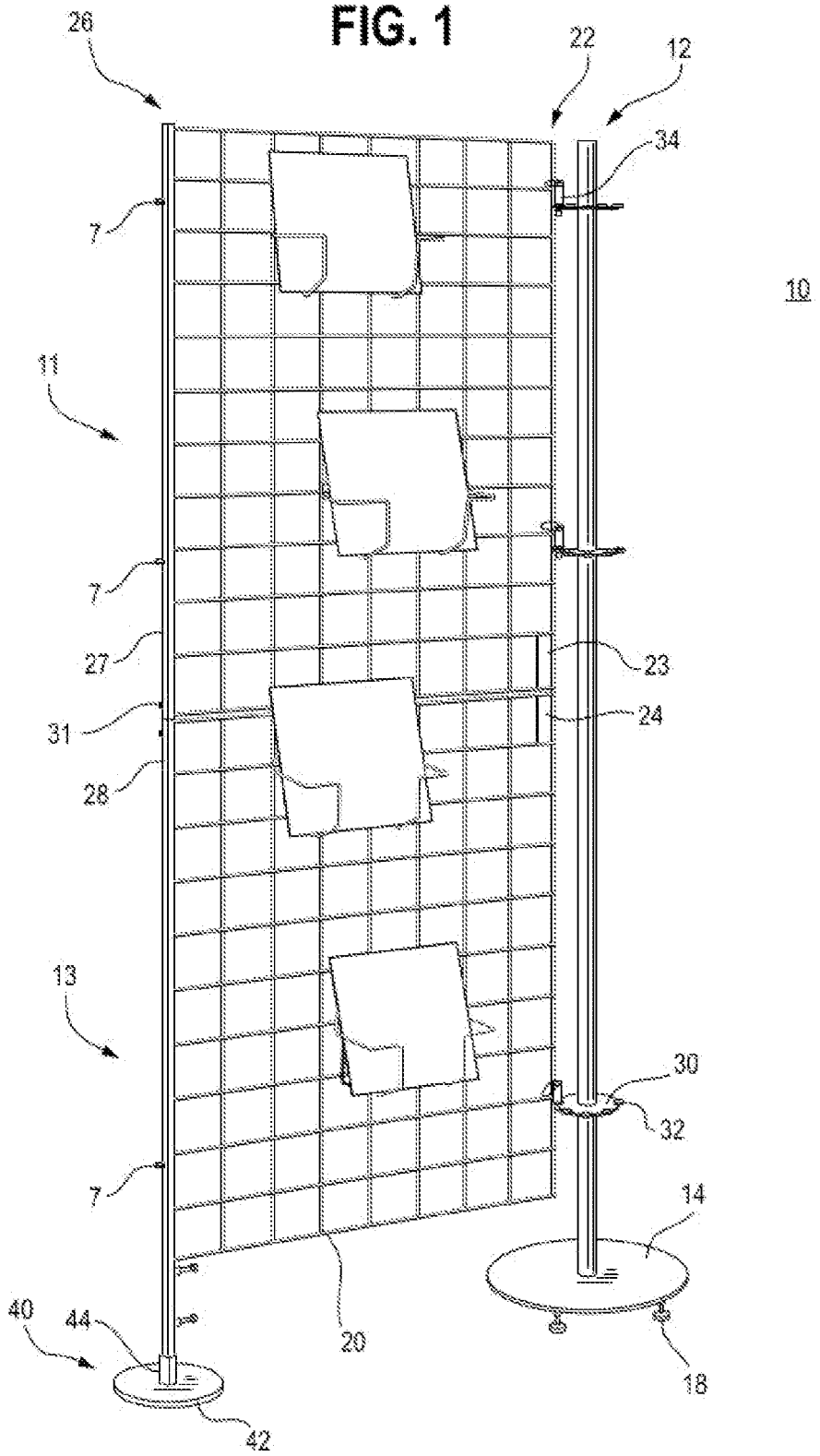
FIG. 1 shows a portable display stand with a single support panel subassembly.
Figure 5:
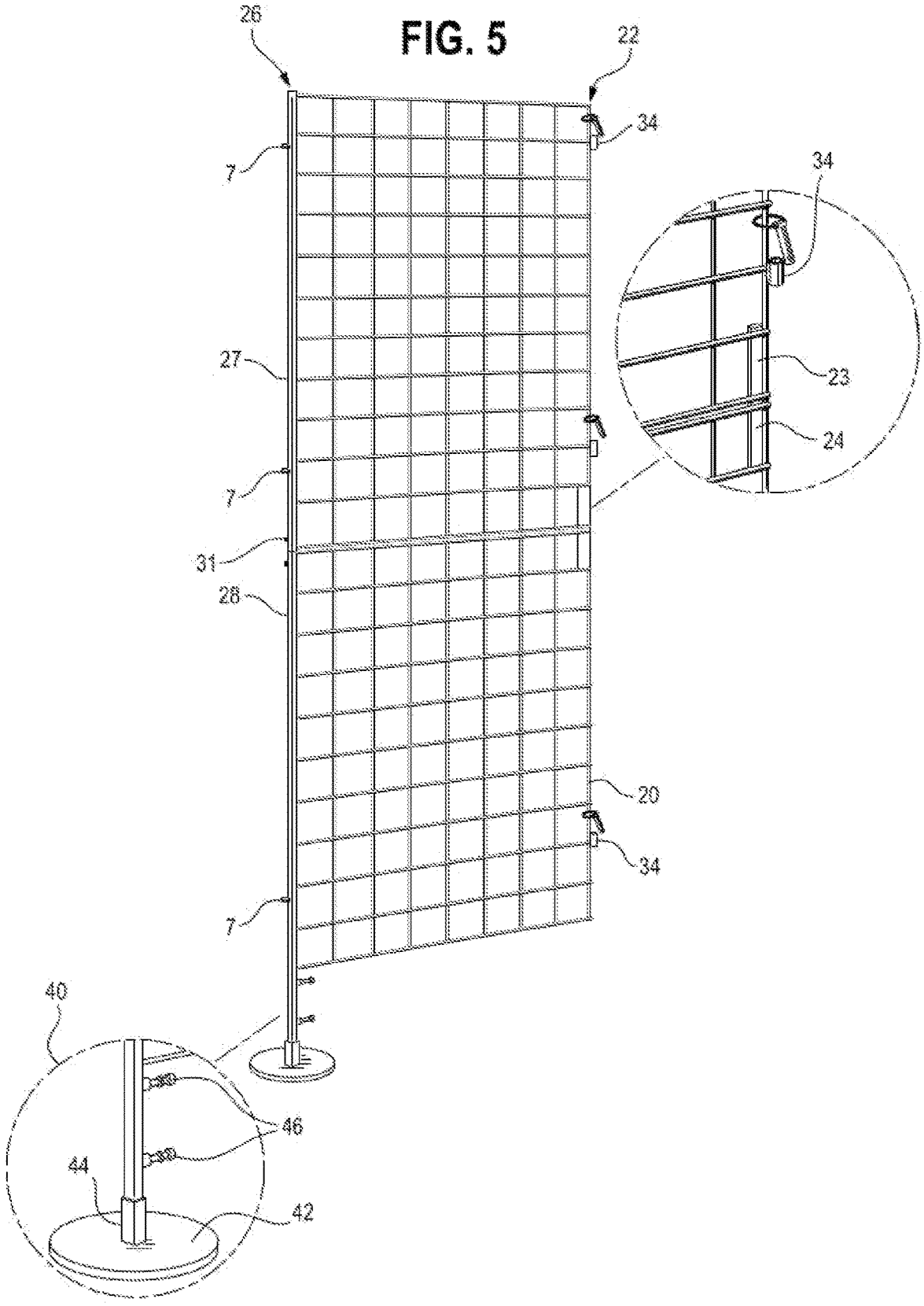
FIG. 5 shows a single support panel subassembly with close-up views of the leg subassembly, the attachment knuckle, the attachment pin, and the first braces.

As shown in FIG. 1, portable display stand 10 comprises vertical central post 12, support panel subassembly 20 having first side edge 22, second side edge 26, and leg subassembly 40 (see FIG. 5). Central post 12 is supported by central base 14. First side edge 22 includes first top brace 23 and first bottom brace 24. The first top brace 23 is attached by a first hinge to the first bottom brace 24. Attachment knuckles 34 having axial continuous passages 33 are attached to first side edge 22. Attachment pins 35 are removably attached to first side edge 22 above attachment knuckles 34. Attachment rings 30 with attachment apertures 32 for receiving attachment pins 35 disposed in the axial continuous passage 33 of attachment knuckles 34 are located on central post 12. Second side edge 26 includes second top brace 27 and second bottom brace 28. In an embodiment, outer attachment knuckles 7 having axial continuous passages are attached to second side edge 26. The second top brace 27 is attached by a second hinge to the second bottom brace 28. The first and second hinges permit folding of the first top brace 23 and first bottom brace 24, on the one hand, and the second top brace 27 and second bottom brace 28, on the other hand, as well as the attached top panel segment 11 and bottom panel segment 13 of the support panel subassembly 20, along the split in the horizontal direction of the support panel subassembly 20 located at or near the vertical midpoint. A first slideable pin 37 lock for the first top brace 23 and first bottom brace 24, and a second slideable pin lock 31 for the second top brace 27 and second bottom brace 28, when slid into engagement, fit snugly within the hollow tubular portions proximate to the first and second gaps of both the top and bottom braces 23, 24 of the first brace, and both the top and bottom braces 27, 28 of the second brace, respectively, so as to stabilize the top panel segment 11 of the support panel subassembly 20 relative to the bottom panel segment 13 of the support panel subassembly 20. Second side edge 26 is supported by leg subassembly 40. Optionally, central base 14 has leg levelers 18 for stabilizing display stand 10. Attachment pins 35 are received within axial continuous passages 33 of attachment knuckles 34 and attachment apertures 32 on attachment rings 30 when display stand 10 is assembled.

Figure 2:
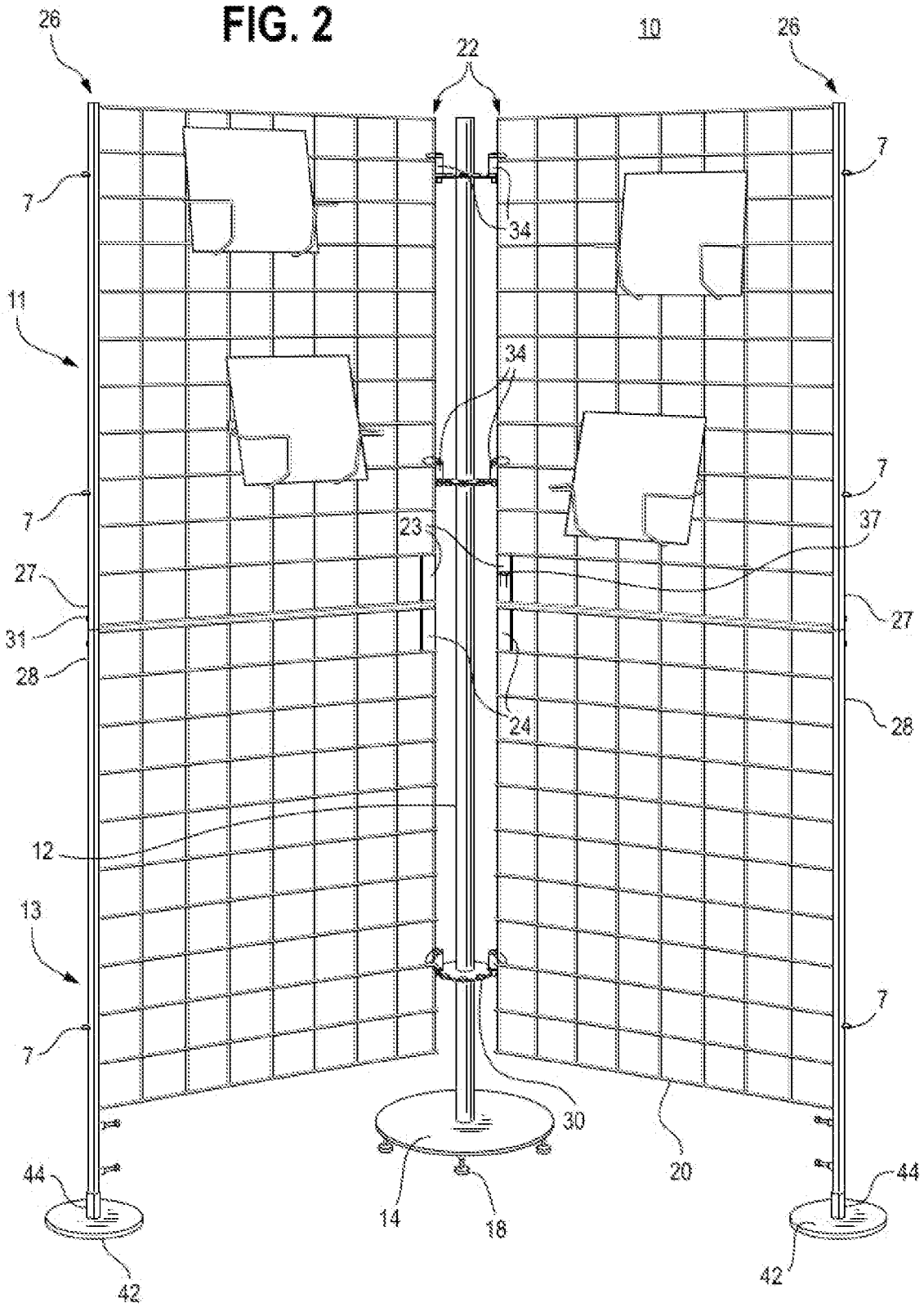
FIG. 2 shows a perspective view of the display stand with two panels.
Figure 3:
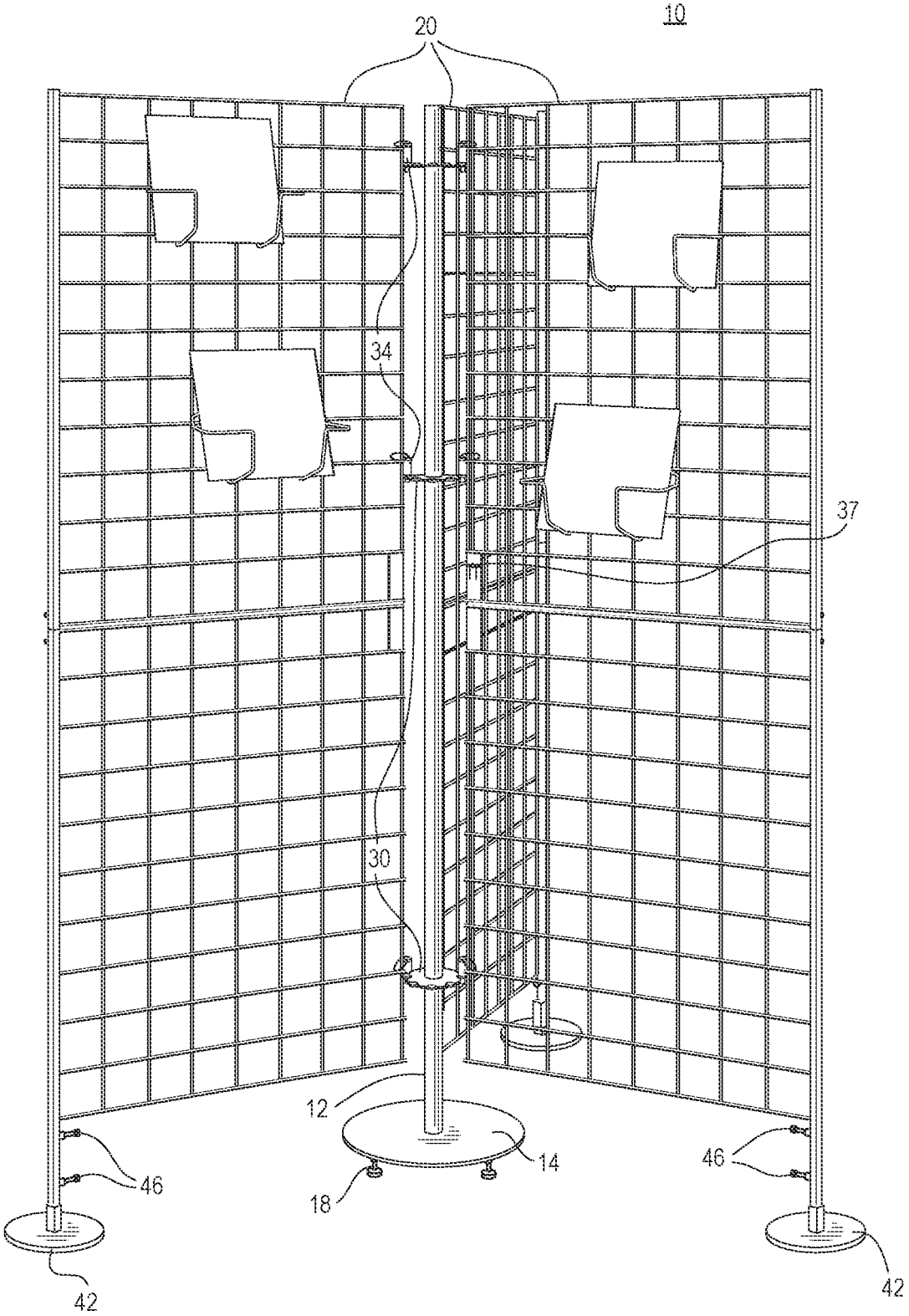
FIG. 3 shows a perspective view of the display stand with three panels.
Figure 4:
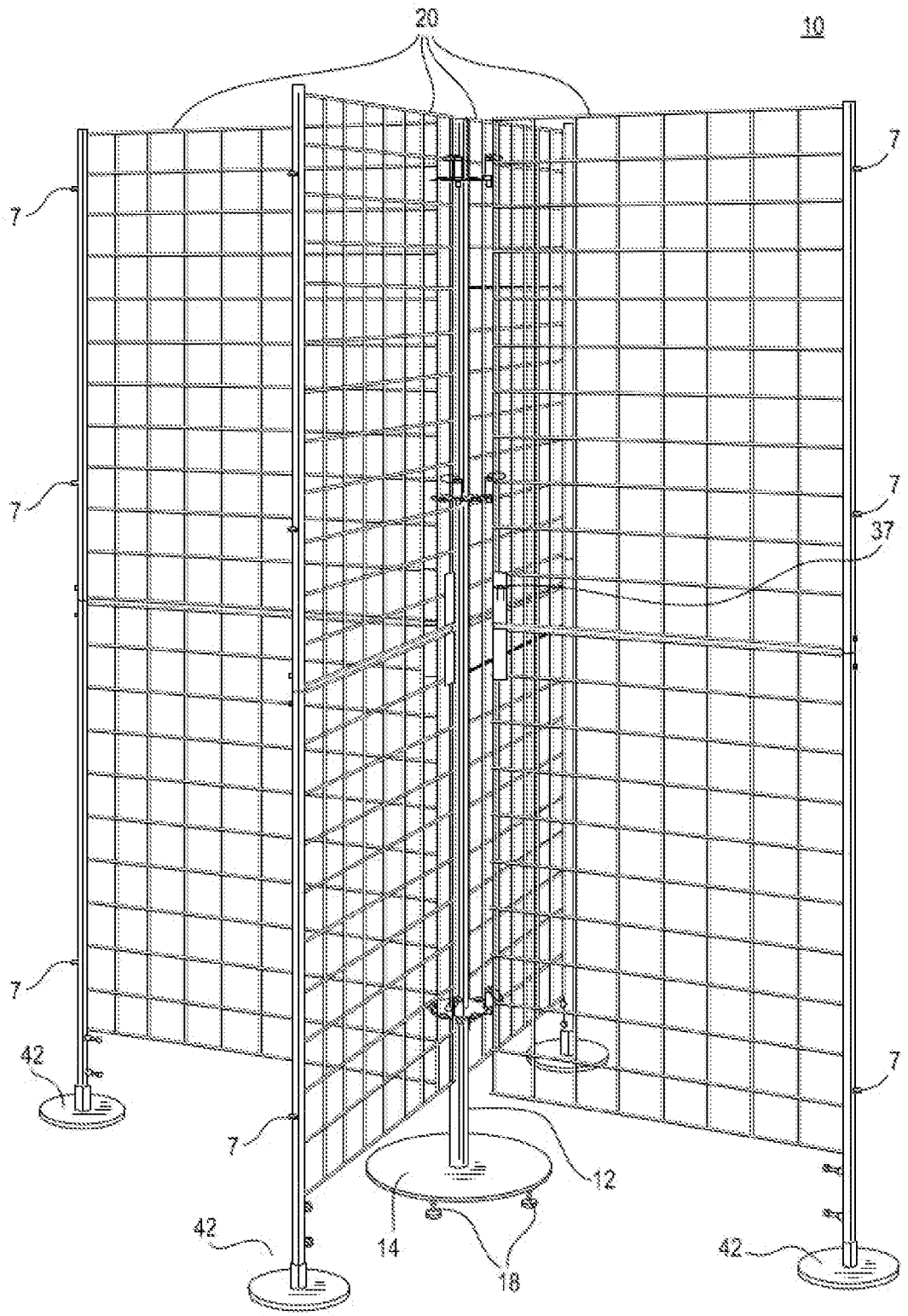
FIG. 4 shows a perspective view of the display stand with four panels.

FIG. 2 shows an embodiment of display stand 10 having two support panel subassemblies 20 engaged with central post 12 via attachment knuckles 34 and attachment pins received 35 within attachment apertures 32 on attachment rings 30. In an embodiment, additional support panel subassemblies are connected to outer attachment knuckles 7 of support panel subassemblies 20 engaged with central post 12. As shown in FIG. 3 and FIG. 4, display stand 10 can also be configured using three or four support panel subassemblies 20 engaged with central post 12 via attachment pins 35 received within axial continuous passages 33 of attachment knuckles 34 and attachment apertures 32.

FIG. 5 shows a single support panel subassembly 20 with attachment knuckles 34, attachment pins 35, first side edge 22, second side edge 26, and leg subassembly 40. Second side edge 26 includes outer attachment knuckles 7 for optional attachment to another support panel subassembly. Leg subassembly 40 includes horizontal leg support 42 and vertical leg support 44. Embodiments having two, three, or four support panel subassemblies engaged with central post 12 are preferred.

Figure 6:
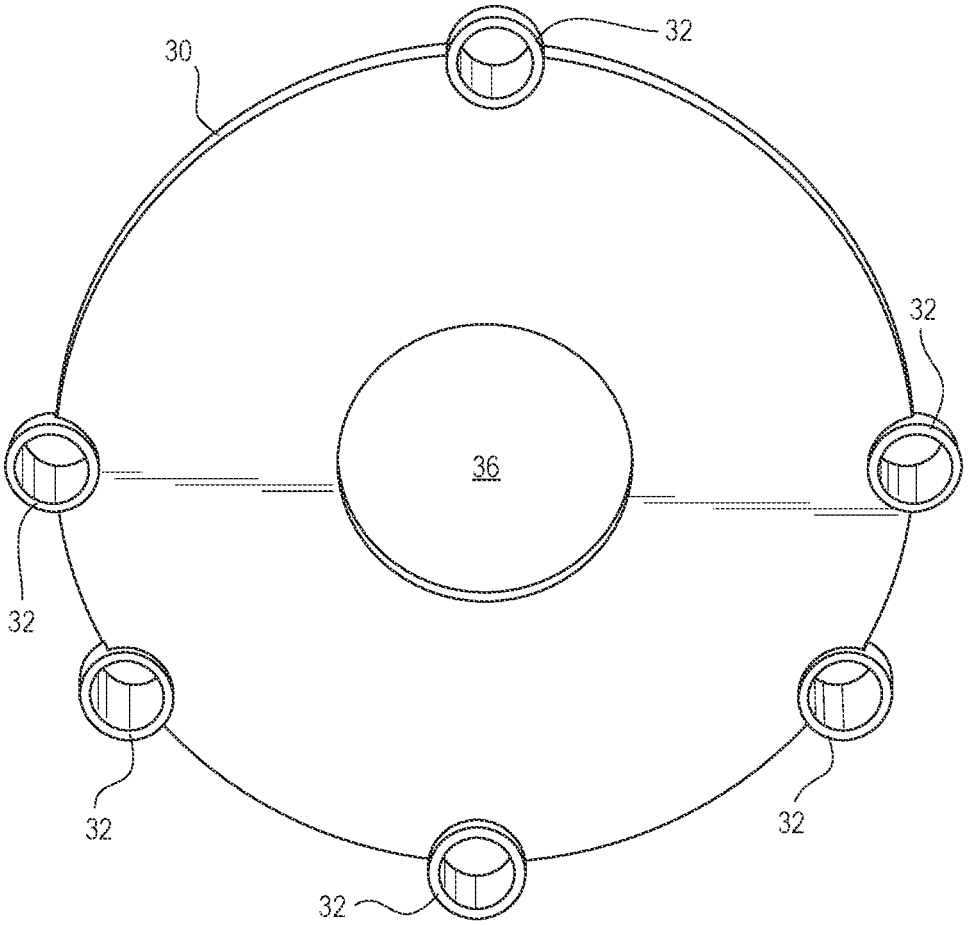
FIG. 6 is a close-up view of the attachment ring.

FIG. 6 shows attachment ring 30 with attachment apertures 32 spaced around the circumference of attachment ring 30. As viewed from the top, in a preferred embodiment, attachment apertures 32 are positioned at 12 o'clock, 3, 4, 6, 8, and 9 o'clock. Post aperture 36 in the central portion of attachment ring 30 is sized to receive central post 12. Preferably, embodiments having two support panel subassemblies will use attachment apertures 32 at the 12 and 6 o'clock positions or at the 3 and 9 o'clock positions of attachment ring 30. Embodiments having three support panel subassemblies will preferably use attachment apertures 32 at the 12, 4, and 8 o'clock positions of attachment ring 30, and embodiments having four support panel subassemblies preferably use attachment apertures 32 at the 12, 3, 6, and 9 o'clock positions of attachment ring 30.

Figure 7:
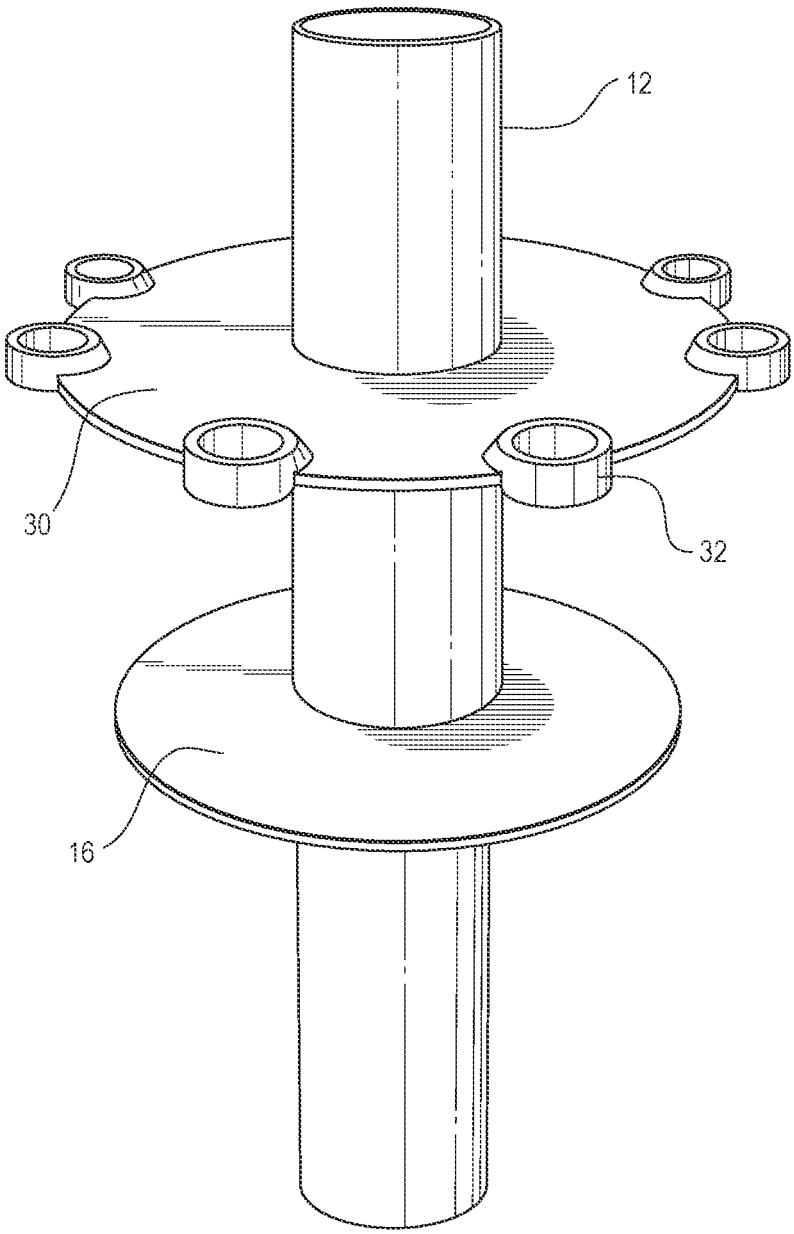
FIG. 7 is a close-up view of the attachment ring adjacent a support disk on a central post segment.

As shown in FIG. 7, support disk 16 is integral with central post 12. Central post 12 is received in post aperture 36 in attachment ring 30. When in the assembled position, attachment ring 30 rests on top of support disk 16. Attachment apertures 32 are positioned at 12 o'clock, 3, 4, 6, 8, and 9 o'clock around the circumference of attachment ring 30.

Figure 8:
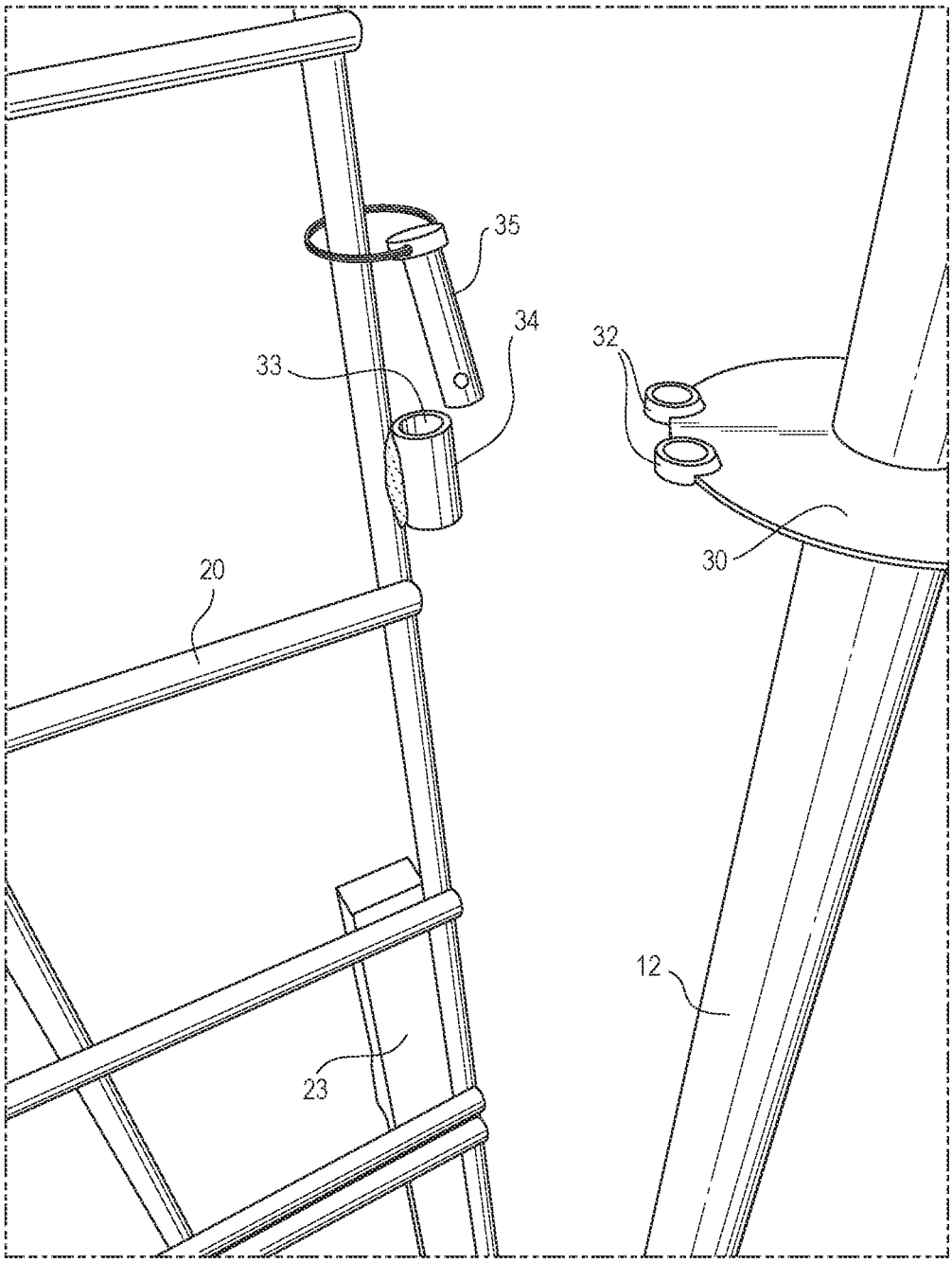
FIG. 8 is a close-up view of the attachment knuckle and attachment pin on the first side edge of the support panel subassembly, and the attachment ring on the central post segment.

As shown in FIG. 8, attachment knuckles 34 and attachment pins 35 are located on first side edge 22 of support panel subassembly 20 and attachment pins 35 are sized to be received within axial continuous passages 33 of attachment knuckles 34 and attachment apertures 32 on attachment ring 30.

Figure 9:
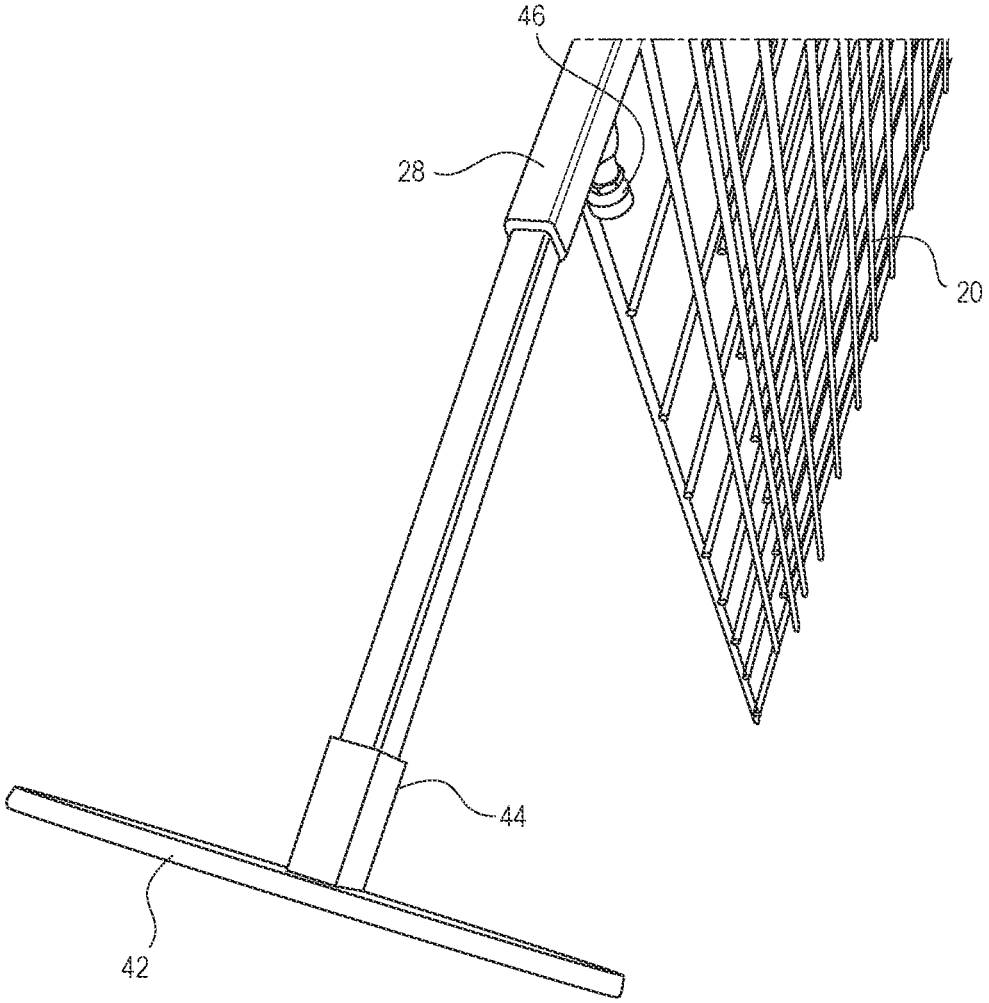
FIG. 9 is a close-up view of the leg subassembly.

As shown in FIG. 9, horizontal leg support 42 is permanently attached to vertical leg support 44. Vertical leg support 44 removably attaches to second bottom brace 28 of support panel subassembly 20 using leg attachments 46 such as, for example, plungers, buttons, or the like. Preferably, the inner cross-sectional dimensions of the lower end portion of second bottom brace 28 are larger than the outer cross-sectional dimensions of vertical leg support 44 such that the upper end portion of vertical leg support 44 fits within the lower end portion of second bottom brace 28.

Figure 10:
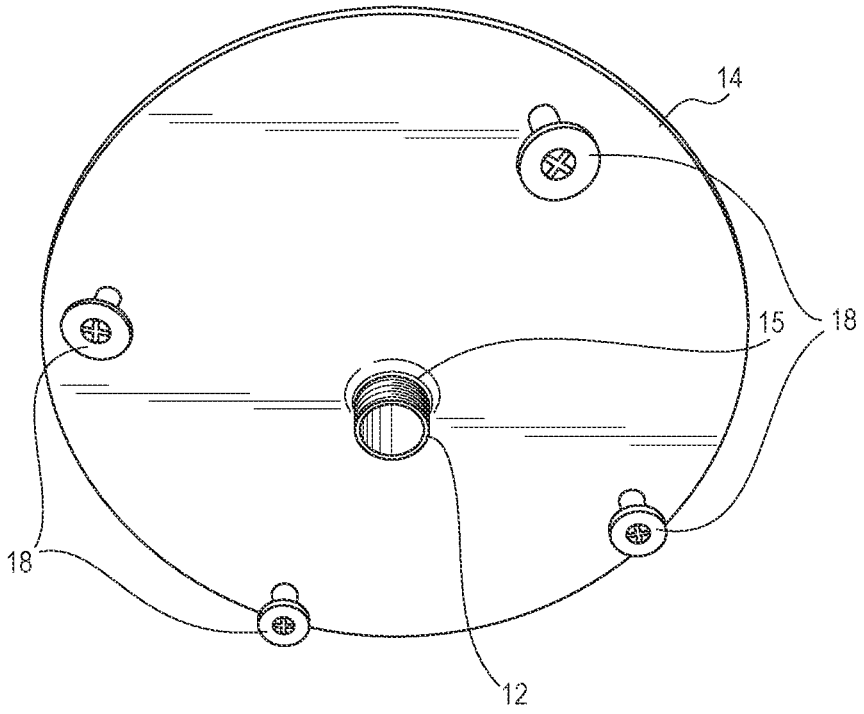
FIG. 10 is a close-up view of the bottom of the central base.

As shown in FIG. 10, central base 14 has base aperture 15 for receiving central post 12 and leveling feet 18. Optionally, the engagement between central post 12 and base aperture 15 is a threaded engagement.

Figure 11:
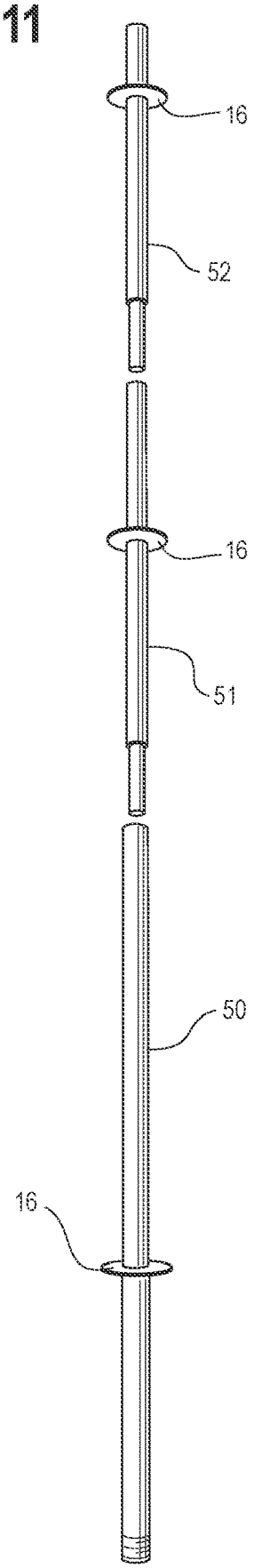
FIG. 11 shows a vertical central post having three post segments.

FIG. 11 shows central post 12 comprising three post segments, bottom post segment 50, middle post segment 51, and upper post segment 52. In an embodiment, bottom post segment 50 has a threaded lower end portion for engagement with central base 14. Integral with each post segment is a support disk 16. Post segments are shaped such that the lower end portion of one segment fits within the upper end portion of the adjacent segment.

Figure 12:
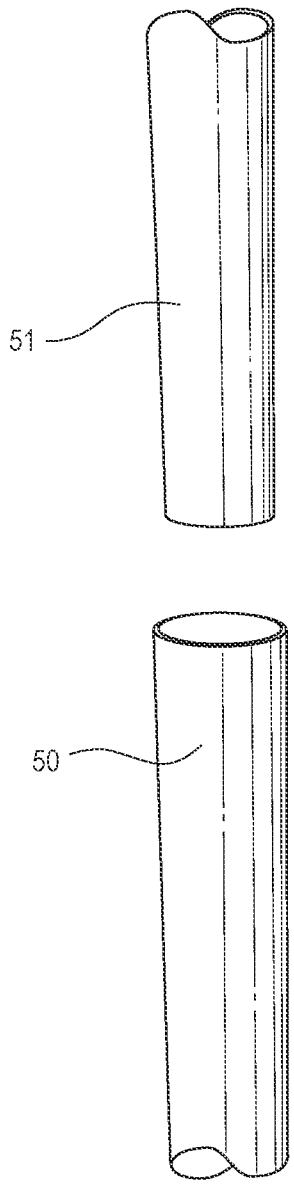
FIG. 12 shows a close-up of the lower end portion of the middle post segment and the upper end portion of the bottom post segment.

As shown in FIG. 12, post segments of central post 12 are sized such that the outer diameter of the lower end portion of segment fits snugly within the upper end portion of the adjacent segment. For example, as shown, the outer diameter of the lower end portion of middle segment 51 of central post 12 is smaller than the inner diameter of the upper end portion of bottom post segment 50 of central post 12 such that the lower end portion of middle post segment 51 fits snugly within the upper end portion of bottom post segment 50.

The use of the terms "a" and "an" and "the" and similar referents in the context of describing materials or methods (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The terms "consisting of" and "consists of" are to be construed as closed terms, which limit any element or part that are listed in a given claim or portion of the specification. In addition, and because of its open nature, the term "comprising" broadly encompasses any element or part that "consist essentially of" or "consist of" specified components or steps, in addition to any element or part that include other any elements or parts or steps beyond those listed in the given claim or portion of the specification. Recitation of ranges of values herein are merely intended to serve as a shorthand method of referring individually to each separate value falling within the range, unless otherwise indicated herein, and each separate value is incorporated into the specification as if it were individually recited herein. All numerical values obtained by measurement are not to be construed as absolutely precise numbers, and should be considered to encompass values within the known limits of the measurement techniques commonly used in the art, regardless of whether or not the term "about" is explicitly stated. The use of any and all examples, or exemplary language (e.g., "such as") provided herein, is intended merely to better illuminate certain aspects of elements or parts described herein and does not pose a limitation on the scope of the claims unless otherwise stated. No language in the specification should be construed as indicating any non-claimed element as essential to the practice of the claims.

Preferred embodiments are described herein, including the best mode known to the inventors for carrying out the claimed invention. Variations of those preferred embodiments may become apparent to those of ordinary skill in the art upon reading the foregoing description. The inventors expect skilled artisans to employ such variations as appropriate, and the inventors intend for the claimed invention to be practiced otherwise than as specifically described herein. Accordingly, the claimed invention includes all modifications and equivalents of the subject matter recited in the claims appended hereto as permitted by applicable law. Moreover, any combination of the above-described elements in all possible variations thereof is encompassed by the claimed invention unless otherwise indicated herein or otherwise clearly contradicted by context.

We claim:

1. A portable display stand comprising:

(1) a hollow tubular central post supported by a central base, the central base having a central aperture sized for receiving a lower end portion of the central post, the central post having a plurality of support disks integral therewith and spaced thereon, wherein the plurality of support disks are substantially flat, circular rings integral with the central post and extending horizontally therefrom;

(2) at least one support panel subassembly wherein each support panel subassembly includes a top panel segment and a bottom panel segment, wherein the top panel segment has a first side edge and a second side edge, and wherein the bottom panel segment has a first side edge and a second side edge, and wherein each support panel subassembly further includes:

(A) a first top brace that is permanently attached to the first side edge of the top panel segment, and a first bottom brace that is permanently attached to the first side edge of the bottom panel segment, with a first gap located between the first top brace and the first bottom brace;

(B) a second top brace that is permanently attached to the second side edge of the top panel segment, and a second bottom brace that is permanently attached to the second side edge of the bottom panel segment, with a second gap located between the second top brace and the second bottom brace;

(C) a first hinge that is located adjacent to the first gap and forms a connection between the first top brace and the first bottom brace, and a second hinge that is located adjacent to the second gap and that forms a connection between the second top brace and the second bottom brace, wherein the first hinge and the second hinge permit the top panel segment and the bottom panel segment of the support panel subassembly to rotate at the first hinge and second hinge between an open position and a closed position;

(D) a hollow tubular portion in the first top brace proximate to the first gap, and a hollow tubular portion in the first bottom brace proximate to the first gap;

(E) a hollow tubular portion in the second top brace proximate to the second gap, and a hollow tubular portion in the second bottom brace proximate to the second gap;

(F) a first slideable pin lock located adjacent to the first gap that is movable between an engaged position and a disengaged position which:

(i) when the top panel segment and the bottom panel segment of the support panel subassembly are in the closed position, the first slideable pin lock is in the disengaged position; and (ii) when the top panel segment and the bottom panel segment of the support panel sub assembly are in the open position, the first slideable pin lock may be moved into the engaged position;

(G) a second slideable pin lock located adjacent to the second gap that is moveable between an engaged position and a disengaged position which:

(i) when the top panel segment and the bottom panel segment of the support panel subassembly are in the closed position, the second slideable pin lock is in the disengaged position; and (ii) when the top panel segment and the bottom panel segment of the support panel subassembly are in the open position, the second slideable pin lock may be moved into the engaged position;

(H) a first locking mechanism for the first slideable pin lock which is movable between a locked position, wherein the first locking mechanism prevents the first slideable pin lock from moving between the engaged position and the disengaged position, and an unlocked position;

(I) a second locking mechanism for the second slideable pin lock which is movable between a locked position, wherein the second locking mechanism prevents the second slideable pin lock from moving between the engaged position and the disengaged position, and an unlocked position;

(J) when the top panel segment and the bottom panel segment of the support panel subassembly are in the closed position, the first locking mechanism of the first slideable pin lock may be moved to a locked position with the first slideable pin lock in the disengaged position, and when the top panel segment and the bottom panel segment of the support panel subassembly are in the open position, the first locking mechanism of the first slideable pin lock may be moved to a locked position with the first slideable pin lock in the engaged position;

(K) when the top panel segment and the bottom panel segment of the support panel subassembly are in the closed position, the second locking mechanism of the second slideable pin lock may be moved to a locked position with the second slideable pin lock in the disengaged position, and when the top panel segment and the bottom panel segment of the support panel subassembly are in the open position, the second locking mechanism of the second slideable pin lock may be moved to a locked position with the second slideable pin lock in the engaged position;

(L) a hollow tubular portion in the second bottom brace that is distal from the second gap;

(M) one or more brace apertures located in the hollow tubular portion of the second bottom brace, wherein one or more spring plungers are attached adjacent the brace apertures;

(N) the spring plungers of the second bottom brace further including a plunger biased by a spring in a direction so as to extend through the brace apertures of the second brace, and wherein each of the spring plungers of the second bottom brace is movable between an engaged position and a disengaged position, wherein:

(i) in the disengaged position, the plunger is retracted against the bias of the spring, and the plunger does not extend substantially through the brace apertures of the second brace; and (ii) in the engaged position, the plunger is not retracted and is biased by the spring so that it may extend substantially through the brace apertures of the second brace;

(O) a plurality of attachment knuckles and attachment pins located on the first side edge of each the top and bottom panel segments, each attachment knuckle of the plurality of attachment knuckles having an axial continuous passage for receiving an attachment pin;

(P) a leg subassembly attached to the second side edge of the bottom panel segment, wherein the leg subassembly includes a horizontal leg support and a vertical leg support permanently attached to the horizontal leg support, wherein:

(i) the vertical leg support includes one or more leg apertures;

(ii) the vertical leg support removably engages the hollow tubular portion of the second bottom brace, and then:

(a) one or more of the brace apertures of the second bottom brace may become located and aligned adjacent to the leg apertures of the vertical leg support when the spring plungers of the second bottom brace are in the disengaged position; and (b) when the spring plungers of the second bottom brace are in the engaged positions, the springs of the spring plungers may bias the plungers of the spring plungers to extend through the brace apertures of the second bottom brace and through the adjacent and aligned leg apertures of the vertical leg support, resulting in a removable attachment of the leg subassembly to the second bottom brace; and (3) an attachment ring on each support disk, each attachment ring having a plurality of attachment apertures spaced around the circumference of the ring for receiving the attachment pins disposed through the axial continuous passages of the attachment knuckles.

2. The portable display stand of claim 1 wherein the first slideable pin lock in the disengaged position is located substantially within either:

(a) the hollow tubular portion of the first top brace proximate to the first gap, or (b) the hollow tubular portion of the first bottom brace proximate to the first gap.

3. The portable display stand of claim 1 wherein the second slideable pin lock in the disengaged position is located substantially within either:

(a) the hollow tubular portion of the second top brace proximate to the second gap, or (b) the hollow tubular portion of the second bottom brace proximate to the second gap.

4. The portable display stand of claim 1 wherein the first slideable pin lock in the engaged position simultaneously:

(a) is located substantially within the hollow tubular portion of the first brace proximate to the first gap, and is also located substantially within the hollow tubular portion of the first bottom brace proximate to the first gap, and (b) forms a first bridge at the first gap between the first top brace proximate to the first gap and the first bottom brace proximate to the first gap.

5. The portable display stand of claim 1 wherein the second slideable pin lock in the engaged position simultaneously:

(a) is located substantially within the hollow tubular portion of the second top brace proximate to the second gap, and is also located substantially within the hollow tubular portion of the second bottom brace proximate to the second gap, and (b) forms a second bridge at the second gap between the second top brace proximate to the second gap and the second bottom brace proximate to the second gap.

6. The portable display stand of claim 1 wherein the first locking mechanism does not prevent the first slideable pin lock from moving between the engaged position and the disengaged position and the second locking mechanism does not prevent the second slideable pin lock from moving between the engaged position and the disengaged position.

7. The portable display stand of claim 1 having at least two support panel subassemblies engaged with the attachment apertures on the attachment rings.

8. The portable display stand of claim 1 wherein a plurality of outer attachment knuckles are located on the second side edge, each outer attachment knuckle having an axial continuous passage for receiving an attachment pin.

9. The portable display stand of claim 8 wherein the attachment pins are adapted to be disposed through the axial continuous passages of the attachment knuckles and outer attachment knuckles.

10. The portable display stand of claim 1 wherein the attachment apertures are positioned at 12 o'clock, 3, 4, 6, 8, and 9 o'clock around the circumference of the attachment ring.

11. The portable display stand of claim 1 wherein the hollow tubular central post comprises at least two post segments, each post segment having a support disk integral therewith, and wherein a lower end portion of a bottom post segment of the central post is sized to be received in the central aperture and a lower end portion of a second post segment is sized to be received in an upper end portion of the bottom post segment.

12. The portable display stand of claim 1 wherein the central base has leg levelers.

13. The portable display stand of claim 1 wherein the leg subassembly comprises a horizontal leg support permanently attached to a hollow vertical leg support wherein an inner cross-sectional dimension of an upper end portion of the vertical leg support is larger than an outer cross-sectional dimension of the second bottom brace such that the upper end portion of the vertical leg support receives the second bottom brace.

14. A portable display stand comprising:

(1) a hollow tubular central post supported by a central base, the central base having a central aperture sized for receiving a lower end portion of the central post, the central post having a plurality of support disks integral therewith and spaced thereon, wherein the plurality of support disks are substantially flat, circular rings integral with the central post and extending horizontally therefrom;

(2) at least one support panel subassembly wherein each support panel subassembly includes a top panel segment and a bottom panel segment, wherein the top panel segment has a first side edge and a second side edge, and wherein the bottom panel segment has a first side edge and a second side edge, and wherein each support panel subassembly further includes:

(A) a first top brace that is permanently attached to the first side edge of the top panel segment, and a first bottom brace that is permanently attached to the first side edge of the bottom panel segment, with a first gap located between the first top brace and the first bottom brace;

(B) a second top brace that is permanently attached to the second side edge of the top panel segment, and a second bottom brace that is permanently attached to the second side edge of the bottom panel segment, with a second gap located between the second top brace and the second bottom brace;

(C) a first hinge that is located adjacent to the first gap and forms a connection between the first top brace and the first bottom brace, and a second hinge that is located adjacent to the second gap and that forms a connection between the second top brace and the second bottom brace, wherein the first hinge and the second hinge permit the top panel segment and the bottom panel segment of the support panel subassembly to rotate at the first hinge and second hinge between an open position and a closed position;

(D) a first slideable pin lock slidably disposed on the first top brace that is movable between an engaged position, wherein the first slideable pin lock engages a tubular portion of the first bottom brace, and a disengaged position which:

(i) when the top panel segment and the bottom panel segment of the support panel subassembly are in the closed position, the first slideable pin lock is in the disengaged position; and (ii) when the top panel segment and the bottom panel segment of the support panel sub assembly are in the open position, the first slideable pin lock may be moved into the engaged position;

(E) a second slideable pin lock slidably disposed on the second top brace that is movable between an engaged position, wherein the second slideable pin lock engages a tubular portion of the second bottom brace, and a disengaged position which:

(i) when the top panel segment and the bottom panel segment of the support panel subassembly are in the closed position, the second slideable pin lock is in the disengaged position; and (ii) when the top panel segment and the bottom panel segment of the support panel subassembly are in the open position, the second slideable pin lock may be moved into the engaged position;

(F) a plurality of attachment knuckles and attachment pins located on the first side edge of each the top and bottom panel segments, each attachment knuckle of the plurality of attachment knuckles having an axial continuous passage for receiving an attachment pin;

(G) a leg subassembly removably attached to the second side edge of the bottom panel segment, wherein the leg subassembly includes a horizontal leg support and a vertical leg support attached to the horizontal leg support; and (3) an attachment ring on each support disk, each attachment ring having a plurality of attachment apertures spaced around the circumference of the ring for receiving the attachment pins disposed through the axial continuous passages of the attachment knuckles.

15. The portable display stand of claim 14 wherein the hollow tubular central post comprises three post segments, each segment having a respective one of the support disks integral therewith, wherein each support disk has a respective one of the attachment rings thereon, and each support panel subassembly has three of the plurality of attachment knuckles having the axial continuous passages and three attachment pins spaced on the first side edge for engagement with an attachment aperture on an attachment ring.

16. The portable display stand of claim 14 having at least two support panel subassemblies engaged with attachment apertures on the attachment rings.

17. The portable display stand of claim 14 wherein the second side edge of the top panel segment and the bottom panel segment each have at least one outer attachment knuckle having an axial continuous passage for engagement with an attachment knuckle on the first side edge of a separate support panel subassembly.

18. The portable display stand of claim 14 wherein the attachment apertures are positioned at 12 o'clock, 3, 4, 6, 8, and 9 o'clock around the circumference of the attachment ring.

19. The portable display stand of claim 14 wherein the central base has leg levelers.

20. The portable display stand of claim 14 wherein an inner cross-sectional dimensions of an upper end portion of the vertical leg support is larger than an outer cross-sectional dimensions of the second bottom brace such that the upper end portion of the vertical leg support receives the second bottom brace.

* * * * *